US007191509B2

(12) United States Patent
Cornelus Van Gastel

(10) Patent No.: US 7,191,509 B2
(45) Date of Patent: Mar. 20, 2007

(54) METHOD FOR ADJUSTING THE SWITCH-GAP BETWEEN THE CONTACT TONGUES OF A REEDS SWITCH

(75) Inventor: Gerardus Judocus Cornelus Van Gastel, Eindhoven (NL)

(73) Assignee: Kearney-National Netherlands Holding B.V., Heerlen (NL)

( * ) Notice: Subject to any disclaimer, the term of this patent is extended or adjusted under 35 U.S.C. 154(b) by 670 days.

(21) Appl. No.: 10/383,752

(22) Filed: Mar. 10, 2003

(65) Prior Publication Data

US 2004/0017275 A1 Jan. 29, 2004

(30) Foreign Application Priority Data

Jul. 10, 2002 (EP) ..... 02077741

(51) Int. Cl.
*H01H 11/00* (2006.01)
*H01H 65/00* (2006.01)

(52) U.S. Cl. ..... 29/622; 219/121.65; 219/121.85; 335/151; 335/154

(58) Field of Classification Search ..... 29/622; 219/121.65, 121.85; 335/151, 154
See application file for complete search history.

(56) References Cited

U.S. PATENT DOCUMENTS 4,179,798 A 12/1979 Einbinder et al.
4,520,254 A 5/1985 Steiger et al.
5,916,463 A * 6/1999 Hoving et al. ..... 219/121.85

FOREIGN PATENT DOCUMENTS

DE 29 18 100 11/1980
WO WO 96/10833 4/1996

* cited by examiner

*Primary Examiner*—A. Dexter Tugbang
*Assistant Examiner*—Tim Phan
(74) *Attorney, Agent, or Firm*—Oblon, Spivak, McClelland, Maier & Neustadt, P.C.

(57) ABSTRACT

The invention relates to a method for adjusting the switch-gap between the overlapping metal tongues of a reed switch contained in a glass envelope, in which a beam of radiation energy is directed through the envelope onto a localised area of at least one of the tongues for a specific period of time, thereby effecting thermally-induced bending of the tongue in question about the irradiated area, wherein a radiation source is used which delivers radiation energy having a wavelength in a range in which the radiation is absorbed by the glass envelope to a considerable extent, and wherein the beam of radiation energy is focussed and measured in such a manner that the proportion between the irradiated glass volume of the envelope and the irradiated metal area of at least one of the tongues that is obtained is such that the temperature of the glass undergoes a temperature increase of less than 100 Kelvin during the time required for heating the metal to the melting point.

4 Claims, 1 Drawing Sheet

METHOD FOR ADJUSTING THE SWITCH-GAP BETWEEN THE CONTACT TONGUES OF A REEDS SWITCH

BACKGROUND OF THE INVENTION

1. Field of the Invention

The present invention relates to a method for adjusting the switch-gap between the overlapping metal tongues of a reed switch contained in a glass envelope, in which a beam of radiation energy is directed through the envelope onto a localised area of at least one of the tongues for a specific period of time, thereby effecting permanent thermally-induced bending of the tongue in question about the irradiated area.

2. Description of the Related Art

Such a method is known from EP 0731978. Said document gives a very extensive description of the principle and the operation of a method for adjusting reed switches, wherein energy is irradiated onto a localised area of at least one of the tongues of the reed switch by means of a radiation source, for example a laser, resulting in a very large localised temperature increase, up to the melting point, effecting permanent bending of the tongue in question, so that the switch-gap formed with the other tongue is changed in a predetermined manner.

Since a great deal of background information on this type of method is provided in said document EP 0731978, said document is considered to be incorporated herein in its entirety.

Currently, an Argon-ion gas laser is used for adjusting reed switches upon production thereof, and to the best of the present inventor's knowledge this is the only laser available for mass production that supplies sufficient power in the frequency range from 488 to 522 nm.

This wavelength has been selected because the glass of the envelope exhibits a minimum absorption with said wavelength, so that damage to the glass caused by an excessive temperature is prevented. The Argon-ion gas laser that is used is a continuous laser which delivers a maximum power of 25 W. In order to be able to do so, the laser requires 55 kW of electric power. The waste heat of said laser must be removed via a thick cooling water pipe. Present in said laser is a plasma tube having a length of about 2 m and the weight of about 100 kg. Such a tube will last about 5500 hours, and it costs about Hfl. 100,000.-. The drawbacks of the use of such a laser operating in the aforesaid wavelength range are its large energy consumption, high cost and low flexibility and reliability.

SUMMARY OF THE INVENTION

In order to overcome these drawbacks, the present invention is based on the insight that on the one hand it is possible to use a more energy-economical, simpler and less costly laser when a longer wavelength of the irradiated energy is used, whilst on the other hand an excessive temperature increase of the glass envelope caused by to a significantly greater absorption of energy by the glass can be prevented by focussing the radiation beam such that the radiation passing through is spread over a larger glass volume in order to realize this, the method according to the invention is characterized in that a radiation source is used which delivers radiation energy having a wavelength in a range in which the radiation is absorbed by the glass envelope to a considerable extent, wherein the beam of radiation energy is focussed and measured in such a manner that the proportion between the irradiated glass volume of the envelope and the irradiated metal area of at least one of the tongues that is obtained is such that the temperature of the glass undergoes a temperature increase of less than 100 Kelvin during the time required for heating the metal to the melting point.

With the method according to the invention, the radiation beam is focussed such that the irradiated glass volume of the envelope is several times, even hundreds of times, larger than the volume of the metal that is being heated. The effect that can be achieved in this way is that the metal is heated to its melting point whilst the temperature of the glass increases by less than 100 Kelvin.

According to a further advantageous embodiment of the method according to the invention, an Nd:YAG laser which produces radiation in the wavelength range of about 1064 nm is used. Said laser delivers energy pulses, wherein the amount of energy per pulse is less than 25 mJ.

As a result of the very short pulse time, the heat will only penetrate into the metal to a small extent, as a result of which also the volume of molten metal will be very small and a relatively small amount of energy per pulse will suffice for causing a small metal volume to melt.

According to the invention, the area irradiated by the beam on the metal tongue surface in question has a diameter of less than 100 μm. As will be explained in more detail yet hereinafter, the radiation energy that passes through the envelope is spread over a significant part of the circumference of the envelope due to the large apex angle of the beam, so that the glass volume that absorbs radiation will be larger than with the known method. As a result, the temperature increase of said glass volume will likewise remain within acceptable bounds.

The invention thus provides a method by means of which reed switches can be adjusted at much lower cost and with a much lower energy consumption, which may be lower by as much as a factor of 50, than with the known method, whilst using a laser of much smaller dimensions than used so far. The method according to the invention will be explained in more detail hereinafter with reference to the drawing.

DETAILED DESCRIPTION OF THE INVENTION

Figure 1:
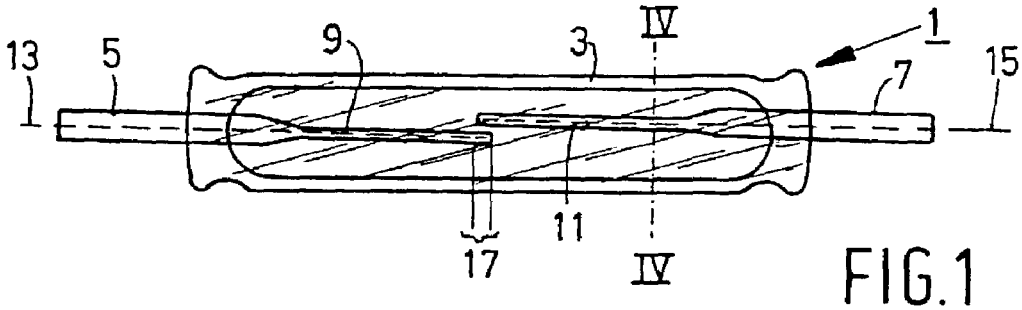
FIG. 1 is a top plan view of a reed switch.
Figure 2:
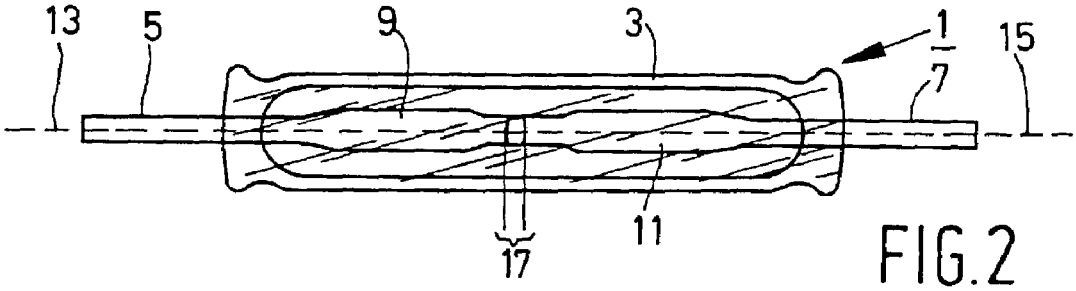
FIG. 2 shows the reed switch according to FIG. 1 in side elevation.

The reed switch, which is indicated by numeral 1 in FIG. 1, comprises a glass envelope 3 containing to metal tongues 5, 7, which have been melted into the opposite ends thereof. The tongues 5, 7, which are made of a soft magnetic material and which extend substantially parallel to each other, have flattened end portions 9, 11. Said portions 9, 11 overlap in the area that is indicated by numeral 17. The longitudinal axes 13 and 15 of the tongues 5, 7 are also shown. FIG. 2 shows the reed switch of FIG. 1 in side elevation.

Figure 3:
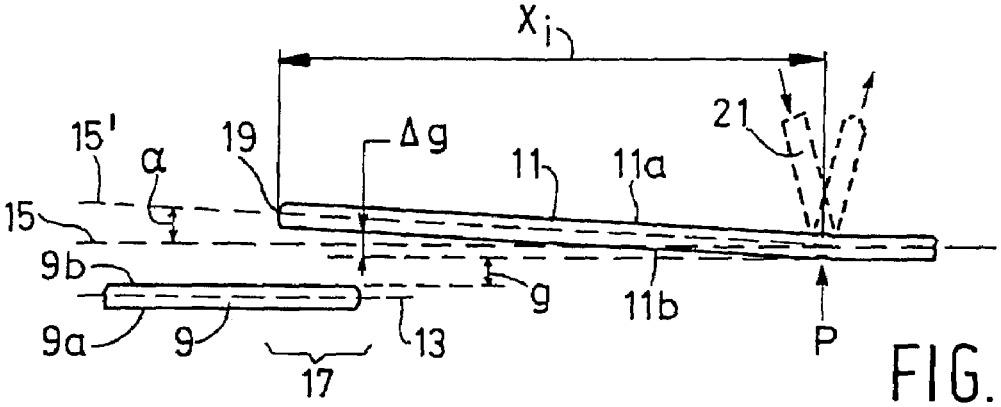
FIG. 3 is a larger-scale view of a detail of the reed switch of FIGS. 1 and 2.

FIG. 3 shows the central portion of the reed switch of FIG. 1 in greater detail. As shown in the figure, the switch is not in its activated position, i.e. an open gap is present between the flattened portions 9 and 11. Each of said portions 9, 11 has a rear side 9*a* and 11*a* and a front side 9*b* and 11*b*. The minimum distance between the front sides 9*b* and 11*b* in fact determines the value of the switch-gap. As described in EP 0731978, said switch-gap must be adjusted very precisely upon manufacture of the switch. As is shown in the figure, the switch-gap between the portions 9, 11 has a value g, but the size of said gap has been increased by a value Δg, using the method according to the invention. In order to achieve this, a localised area on the rear side 11*a* of the tongue 11 is irradiated at p for a short period of time, which location p is spaced from the free end 19 of the flattened portion 11 by a distance $x_i$. The free end of the tongue 11 is bent through a small angle about the area p with respect to the longitudinal axis 15 of the tongue, in a direction away from the other tongue 9. The radiation beam 20 is schematically indicated by a dotted line. Irradiation can also take place on the other side of the tongue 11, in which case the end 19 of said tongue will bend in the direction of the opposite tongue 9. The radiation beam 20 is produced by a pulsed Nd:YAG laser, which delivers radiation having a wavelength of 1064 nm. With this wavelength, the radiation is maximally absorbed by the green glass of the envelope. In order to prevent a temperature increase of the glass envelope such that this would lead to damage to the glass, a pulse energy per pulse of less than 25 mJ is used. Furthermore, the dimension of the irradiated area P on the tongue is less than 100 μm. Under these conditions, the irradiated glass volume 20 appears to be about 800 times larger than the metal volume P that is caused to melt. Said metal volume is so small because in the first place the area being irradiated by the beam has a diameter of only $60.10^{-6}$ cm, whilst the short pulse time and the low pulse energy ensure that the radiation energy will only penetrate the metal to a very small depth. As a result, the metal volume that is caused to melt is very small, about 800 times smaller than the glass volume 20 of the envelope that absorbs radiation. The consequence of this is that while a very small localised area P is caused to melt. i.e. undergoing a temperature increase of about 3000 K, by the energy irradiated thereon, the glass volume at the same time undergoes a temperature increase of only 30 K. This means that the radiation that passes through the envelope will not cause any damage to the glass with this advantageous configuration, either.

In this way an adequate, quick and reliable adjustment of reed switches can be effected by using a laser which delivers radiation having a much greater wavelength, in this case 1064 nm. Thus, a much cheaper, energy-economical, reliable and flexible radiation source can be used with this method, because fibers may be used for directing the radiation to the desired spots. All the above advantages render the method according to the invention very suitable for use in the production process.

The invention claimed is:

1. A method for adjusting a switch-gap between overlapping metal tongues of a reed switch contained in a glass envelope, comprising the steps of:

directing a beam of radiation energy through the glass envelope onto a localised area of at least one of the metal tongues for a specific period of time;

effecting thermally-induced bending of the metal tongue in question about said localised area, by delivering, with use of a radiation source, radiation energy having a wavelength in a range of about 1064 nm;

absorbing part of the radiation energy by the glass envelope; and focusing and measuring the beam of radiation energy such that a proportion between an irradiated glass volume of the glass envelope and an irradiated metal area of at least one of the metal tongues that is obtained is such that a temperature of the glass envelope undergoes a temperature increase of less than 100 Kelvin during a time required for heating the at least one metal tongue to the melting point.

2. The method according to claim 1, wherein an Nd:YAG laser, which produces radiation in the wavelength range of about 1064 nm, is used as the radiation source.

3. The method according to claim 1, wherein energy per pulse emitted by the radiation source is less than 25 mJ.

4. The method according to claim 1, wherein a dimension of the irradiated metal area of at least one of the metal tongues is smaller than 100 μm.

* * * * *